United States Patent [19]

Miller

[11] Patent Number: 4,797,220

[45] Date of Patent: Jan. 10, 1989

[54] DESCALING AND ANTI-OXIDIZING COMPOSITION AND PROCESS THEREFOR

[76] Inventor: Dale A. Miller, 110 W. Missouri, #26, Phoenix, Ariz. 85013

[21] Appl. No.: 151,712

[22] Filed: Feb. 3, 1988

[51] Int. Cl.[4] ..... C11D 7/32

[52] U.S. Cl. ..... 252/82; 252/143; 252/180; 134/41; 134/42

[58] Field of Search ..... 252/82, 143, 180; 134/41, 42

[56] References Cited

U.S. PATENT DOCUMENTS 3,671,447 6/1972 Kowalski ..... 252/180
4,435,303 3/1984 Abadi ..... 252/82

FOREIGN PATENT DOCUMENTS 3042507 5/1981 Fed. Rep. of Germany ..... 252/82

*Primary Examiner*—Robert A. Wax
*Attorney, Agent, or Firm*—David G. Rosenbaum; Harry M. Weiss

[57] ABSTRACT

The present invention relates to a chemical composition which, when made into an aqueous solution according to the method of the present invention, liberates gaseous molecular oxygen and carbon dioxide from oxides and carbonates while simultaneously sequestering various metal ions.

The chemical composition of the present invention consists generally of a mixture of (i) a hydroxycarboxylic acid; (ii) an alcohol; and (iii) an alkanolamine.

22 Claims, No Drawings

DESCALING AND ANTI-OXIDIZING COMPOSITION AND PROCESS THEREFOR

BACKGROUND OF THE INVENTION

The present invention relates to a chemical composition and process for use in the removal and prevention of scale build-up, rust and corrosion. More particularly, the present invention relates to a chemical composition which, when made into an aqueous solution, liberates gaseous molecular oxygen and carbon dioxide from oxides and carbonates while simultaneously sequestering various metal ions. By binding metal ions in a soluble complex any precipitate already formed becomes stabilized and further precipitation is inhibited. The present invention has been found particularly effective in removing and preventing scale, rust, algal and baterial growth and cavitation erosion in automotive-engine cooling systems, industrial evaporative cooling-tower refrigeration systems, evaporative coolers and boilers which employ recirculating aqueous systems. However, by employing the composition of the present invention, non-recirculating aqueous systems may be made to recirculate an aqueous solution of the present invention.

DESCRIPTION OF THE PRIOR ART

Heretofore, attempts by those skilled in the art, to formulate and make a highly effective de-scaling and anti-oxidizing composition have met with limited success. Exemplary of prior art compositions are U.S. Pat. No. 3,518,203 issued on June 30, 1970 to Emillio A. Savinelli and James K. Rice, entitled "Corrosion and Scale Inhibitor Compositions and Processes Therefor" and U.S. Pat. No. 4,435,303 issued on Mar. 6, 1984 to Khodabandeh Abadi, entitled "Descaling Composition." U.S. Pat. No. 3,518,203 (hereinafter the "'203 patent") discloses a composition consisting of (i) a divalent metal ion selected from the group consisting of zinc, cadmium and mixtures thereof; (ii) amino tri(alkylphosphoric) acid or salt thereof; and, (iii) a leucocyanidin-catechin polymer. According to that patent, a preferred composition consists of about 5 parts of leucocyanadin-catechin polymer, about ½ to 3 parts amino tri(methyl phosphoric) acid and about 1-3 parts zinc or cadmium ions. When used with copper cooling systems, it is desirable to include about 0.05-0.5 parts of a copper corrosion inhibitor such as diethyldithiourea or a dialkyldithiocarbamate. In use, the total concentration of the composition in aqueous solution is stated to be about 10-300 ppm. Efficacy testing of the composition of the '203 patent showed a fifty percent reduction in scale deposits on steel and reduced scale deposits on copper specimens from 34 mg to 0.9 mg. Corrosion rates were similarly reduced from 101.9 mils per year (mpy) for the control to 0.87 mpy when the composition of the '203 patent was employed with a low carbon steel.

The composition disclosed by U.S. Pat. No. 4,435,303 (hereinafter the "'303 patent") consists of (i) an anionic fatty alcohol metal sulfate surfactant; (ii) a nonionic substituted poly(ethylene oxide, surfactant; (iii) an ethanolamine having the formula $$NR_{3-x}(CH_2CH_2OH)_x$$

wherein R is hydrogen or an alkyl group having 1-4 carbon atoms and x is an integer of 1-3; and, zinc. Preferred fatty alcohol metal sulfates are identified as alkali metals having 10-14 carbon atoms. Preferred poly(ethylene oxide) surfactants are those of the formula

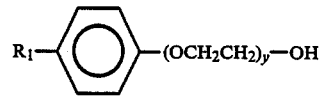

wherein $R_1$ is an alkyl group of about 8 to 10 carbon atoms and y is an integer of about 1-70, preferably 9 or 10, or a compound of the formula:

$$R_2(OCH_2CH_2)_zOH$$

wherein $R_2$ is an alkyl group having about 11-15 carbon atoms and z is an integer between 3 and 40. The preferred ethanolamine is identified as triethanolamine.

According to the teaching of the '303 patent, the preferred solution has a weight to volume percent mixture of the composition to water of about 8 to 50, the preferable range being 10-25. The preferred amount of water is about 4.5 weight to volume percent mixture of the composition to water. The '303 patent also discloses a method for preparing a descaling composition which consists of the steps of: (1) mixing a nonionic substituted poly(ethylene oxide) surfactant with a mixture of zinc and a fatty alcohol metal sulfate; (2) adding an ethanolamine; and (3) adding hydroxy acetic acid; wherein the ratio by weight of zinc to the non-ionic surfactant plus the anionic surfactant is between about 9:1 to 10:1, the ratio by weight of the nonionic surfactant to the anionic surfactant to the ethanolamine is about 1:1:1, and the ratio by weight of the hydroxyacetic acid to the non-ionic surfactant plus the anionic surfactant plus the ethanolamine is about 1:2. However, the composition of the '303 patent is effective at pH 1.5-2.5, a highly acidic environment.

In contradistinction to the '203 and '303 patents, the present invention facilitates capture of dissolved solids to attain dissolved solids loading levels which are on the order of $10^4$-$10^5$ higher than the prior art. Additionally, the composition of the present invention is virtually completely bio-degradable, non-toxic and non-corrosive.

A need has, therefore, been recognized for a descaling and antioxidizing composition and process therefor which permits greater loading of dissolved solids, is bio-degradable, non-toxic and non-corrosive.

SUMMARY OF THE INVENTION

Accordingly, it is an object of the present invention to provide an aqueous chemical composition for use in aqueous systems to prevent scale build-up, oxidization, algal and bacterial growth and cavitation erosion.

It is a further object of the present invention to provide an aqueous chemical composition capable of significantly greater degrees of loading of dissolved solids in solution.

It is yet a further object of the present invention to provide a chemical composition which exhibits utility in automotive-engine cooling systems, industrial evaporative cooling-tower refrigeration systems, evaporative coolers and boilers.

It is a still further object of the present invention to provide a chemical composition which is almost completely bio-degradable, non-toxic and non-corrosive.

It is another object of the present invention to provide a chemical composition which binds metal ions in a soluble complex, thereby preventing precipitation.

It is another further object of the present invention to provide a chemical composition which liberates gaseous molecular oxygen and carbon dioxide from oxides and carbonates and, simultaneously, sequesters metal ions in a soluble complex.

These and other objects hereinafter disclosed and taught by this invention will be apparent from the following, more particular, description of the preferred embodiments of the invention.

DETAILED DESCRIPTION OF THE PREFERRED EMBODIMENTS

The chemical composition of the present invention consists generally of a mixture of (i) a hydroxycarboxylic acid; (ii) an alcohol; and, (iii) an alkanolamine. Preferred hydroxycarboxylic acids for the present invention have the general formula (I):

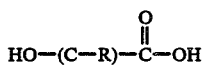

(I)

wherein R is hydrogen, a branched or straight chain alkyl, cycloalkyl, or aryl substituent having one or more carbon atoms and forms a stable C—R complex which does not inactivate the carboxylic acid group. The preferred hydroxycarboxylic acid is hydroxy-acetic acid wherein the C—R complex is a methane radical.

Preferred alcohols for the present invention have the general formula (II):

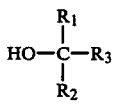

(II)

wherein $R_1$, $R_2$ and $R_3$ are each selected from the group consisting of hydrogen, a branched or straight chain alkyl group, a cycloalkyl group or an aryl group. Preferred alcohols of general formula II are methanol, wherein $R_1$, $R_2$ and $R_3$ are each hydrogen, and ethylene glycol, wherein $R_1$ and $R_2$ are hydrogen and $R_3$ is $—CH_2OH$.

Finally, preferred alkanolamines for the present invention have the general formula (III):

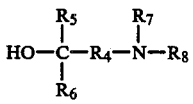

(III)

wherein $R_4$ is an branched or straight chain alkyl group having from 0–5 carbon atoms, and $R_5$, $R_6$, $R_7$ and $R_8$ are selected from the group consisting of hydrogen, a branched or straight chain alkyl group, a cycloalkyl group or aryl group, such that the cumulative electrochemical effect of the substituent groups does not create an overly positive charge and negate the basicity of the alkanolamine. Preferred alkanolamines of general formula (III) consist of methanolamine, wherein $R_4$ is not present and $R_5$, $R_6$, $R_7$ and $R_8$ are each hydrogen, and triethanolamine, wherein $R_4$ is $CH_2$, $R_5$ and $R_6$ are each hydrogen and $R_7$ and $R_8$ are ethanol radicals.

In use, the aqueous chemical composition of the present invention is added to water in a recirculating aqueous system. Aqueous systems which are non-recirculating may be recirculated to increase the rate of reaction. If a relatively higher reaction rate is not required, non-recirculating systems may remain so. Solutions of about 0.5% to 5%, by volume, of the present invention to water are usually sufficient to maintain a previously cleaned aqueous system. To clean a scaled and/or rusted aqueous system, solutions of up to 50%, by volume, of the aqueous chemical composition in water may be employed. Higher concentrations and higher reaction temperatures increase the rate of the descaling and antioxidizing reaction. It has been found, however, that concentrations in excess of 50% by volume do not exhibit statistically significant further increases in reaction rate.

Depending upon the composition of the dissolved solids, the solution has been found to lose effectiveness as its specific gravity begins to exceed 1.05. Thus, as the specific gravity begins to exceed that level, it is advisable to drain the entire aqueous solution, refill the aqueous system and re-treat the system with the aqueous chemical composition of the present invention.

PREPARATION OF THE PREFERRED EMBODIMENT

The aqueous chemical composition of the present invention is prepared by mixing together a hydroxycarboxylic acid of general formula (I), an alcohol of general formula (II) and an alkanolamine of general formula (III). The volume percentage of the hydroxycarboxylic acid to the total mixture is in the range of about 25–60%, with about 35–45% being the preferred volume percentage. The efficacious ratio of hydroxycarboxylic acid to alkanolamine, i.e., (I):(III), is in the range of about 0.7 to 10, with 2.0–3.5 being the preferred ratio. Finally, an efficacious ratio of alkanolamine to alcohol, i.e., (III):(II), is in the range of about 0.5–6.0, with a preferred ratio in the range of about 1–2.

It has been found that the addition of water facilitates the reaction. A minimum of about 20% by volume of water to end volume is used to dilute the alkanolamine. Additionally, for most end uses, non-ionic surfactants should be added to reduce surface tension of the aqueous solution. The addition of non-ionic surfactants serves to reduce cavitation erosion and facilitate dissolution of chemical products formed during use.

Mixture of the inventive chemical composition is preferably carried out by the following steps. First, if water is to be used, it should be mixed with the alkanolamine. Second, the hydroxycarboxylic acid is added to the alkanolamine. The resulting reaction is extremely exothermic and the heat generated should be dissipated until the mixture is at or near room temperature. After cooling the mixture to room temperature, the alcohol is added in relative proportions while stirring the mixture. The reaction is complete when all of the striae, roughly resembling a oil in water mixture, have disappeared.

The cooling step has been found to be especially important to the ultimate effectiveness of the final composition. Lower degress of effectiveness have been associated with resulting solutions where the hydroxycarboxylic acid-alkanolamine mixture has not been sufficiently cooled prior to addition of the alcohol.

While the invention has been particularly shown and described in reference to the preferred embodiments thereof, it will be understood by those skilled in the art that changes in form and details may be made without departing from the spirit and scope of the invention.

I claim:

1. A chemical composition comprising:

(a) a hydroxycarboxylic acid having the formula

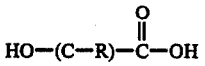

(I)

wherein R is hydrogen, a branched or straight chain alkyl, cycloalkyl or aryl substituent having one or more carbon atoms and which does not inactivate the carboxylic acid group;

(b) an alcohol having the formula

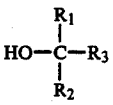

(II)

wherein $R_1$, $R_2$ and $R_3$ are each selected from the group consisting of hydrogen, a branched or straight chain alkyl group, a cycloalkyl group or an aryl group; and (c) an alkanolamine having the formula

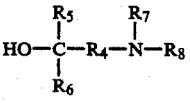

(III)

wherein $R_4$ is an branched or straight chain alkyl group having from 0–5 carbon atoms, and $R_5$, $R_6$, $R_7$ and $R_8$ are selected from the group consisting of hydrogen, a branched or straight chain alkyl group, a cycloalkyl group or aryl group.

2. The chemical composition according to claim 1, wherein said hydroxycarboxylic acid comprises hydroxyacetic acid.

3. The chemical composition according to claim 1, wherein said alcohol comprises methanol.

4. The chemical composition according to claim 1, wherein said alcohol comprises ethylene glycol.

5. The chemical composition according to claim 1, wherein said alkanolamine comprises methanolamine.

6. The chemical composition according to claim 1, wherein said alkanolamine comprises triethanolamine.

7. The chemical composition according to claim 1, wherein said hydroxycarboxylic acid comprises about 25–60% by volume of the total composition.

8. The chemical composition according to claim 1, wherein said hydroxycarboxylic acid and said alkanolamine are present in a ratio of hydroxycarboxylic acid to alkanolamine in the range of about 0.7–10.

9. The chemical composition according to claim 1, wherein said alcohol and said alkanolamine are present in a ratio of alkanolamine to alcohol in the range of about 0.5–5.

10. The chemical composition according to claim 1, further comprising a non-ionic surfactant.

11. A process for preparing a chemical composition, comprising the steps of:

(a) mixing a hydroxycarboxylic acid having the formula

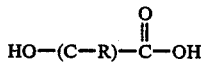

wherein R is hydrogen, a branched or straight chain alkyl, cycloalkyl or aryl substituent having one or more carbon atoms and which does not inactivate the carboxylic acid group; with an alkanolamine having the formula

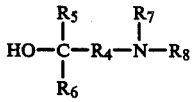

wherein $R_4$ is an branched straight chain alkyl group having from 0–5 carbon atoms, and $R_5$, $R_6$, $R_7$ and $R_8$ are selected from the group consisting of hydrogen, a branched or straight chain alkyl group, a cycloalkyl group or aryl group;

(b) cooling the resulting mixture to about room temperature; and (c) adding to said resulting mixture an alcohol having the formula

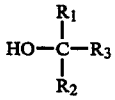

wherein $R_1$, $R_2$ and $R_3$ are each selected from the group consisting of hydrogen, a branched or straight chain alkyl group, a cycloalkyl group or an aryl group.

12. The method of claim 11, wherein said step of mixing hydroxycarboxylic acid and said ethanolamine includes providing said hydroxycarboxylic acid such that the volume percent of said hydroxycarboxylic acid is in the range of about 25–60%.

13. The method of claim 12, wherein said step of mixing said hydroxycarboxylic acid and said ethanolamine includes adding said ethanolamine to said hydroxycarboxylic acid such that the concentration ratio of said hydroxycarboxylic acid to said ethanolamine is in the range of about 0.7 to 10.

14. The method of claim 11, wherein said step of adding said alcohol includes adding said alcohol such that the concentration ratio of ethanolamine to alcohol is in the range of about 0.5–6.

15. The method of claim 11, further comprising the step of mixing said alkanolamine with water prior to mixing said hydroxycarboxylic acid to said alkanolamine.

16. The method of claim 15, wherein said step of mixing said alkanolamine with water includes adding greater than or equal to 20% by volume of water to said alkanolamine.

17. The method of claim 11, further comprising the step of mixing said resulting composition until striae present in the mixture disappear.

18. The method of claim 11, wherein said hydroxycarboxylic acid comprises hydroxyacetic acid.

19. The method of claim 11, wherein said alcohol comprises methanol.

20. The method of claim 11, wherein said alcohol comprises ethylene glycol.

21. The method of claim 11, wherein said alkanolamine comprises methanolamine.

22. The method of claim 11, wherein said alkanolamine comprises triethanolamine.

* * * * *